US009306264B2

(12) United States Patent
Tageman

(10) Patent No.: US 9,306,264 B2
(45) Date of Patent: Apr. 5, 2016

(54) TRANSITION BETWEEN A MICROSTRIP PROTRUDING INTO AN END OF A CLOSED WAVEGUIDE HAVING STEPPED SIDEWALLS

(75) Inventor: Ola Tageman, Göteborg (SE)

(73) Assignee: TELEFONAKTIEBOLAGET L M ERICSSON (PUBL), Stockholm (SE)

( * ) Notice: Subject to any disclaimer, the term of this patent is extended or adjusted under 35 U.S.C. 154(b) by 0 days.

(21) Appl. No.: 14/350,375

(22) PCT Filed: Oct. 18, 2011

(86) PCT No.: PCT/EP2011/068154

§ 371 (c)(1), (2), (4) Date: Apr. 8, 2014

(87) PCT Pub. No.: WO2013/056729

PCT Pub. Date: Apr. 25, 2013

(65) Prior Publication Data

US 2014/0266493 A1 Sep. 18, 2014

(51) Int. Cl.
*H01P 5/107* (2006.01)
*H01P 5/08* (2006.01)

(52) U.S. Cl.
CPC . *H01P 5/107* (2013.01); *H01P 5/08* (2013.01)

(58) Field of Classification Search
CPC ..... H01P 5/107
USPC ..... 333/26, 34
See application file for complete search history.

(56) References Cited

U.S. PATENT DOCUMENTS

| | | | | |
|---|---|---|---|---|
| 4,901,040 | A * | 2/1990 | Ahlborn et al. | 333/26 |
| 6,265,950 | B1 * | 7/2001 | Schmidt et al. | 333/26 |
| 6,396,364 | B1 * | 5/2002 | Qvist | 333/26 |
| 2004/0263277 | A1 * | 12/2004 | Ding et al. | 333/21 R |
| 2008/0266196 | A1 * | 10/2008 | Shi | 343/772 |
| 2009/0091402 | A1 * | 4/2009 | Cho | 333/26 |

FOREIGN PATENT DOCUMENTS

| | | | |
|---|---|---|---|
| EP | 2290741 | A | 3/2011 |
| JP | 2004015472 | A | 1/2004 |
| WO | 0038272 | A1 | 6/2000 |
| WO | 02071533 | A1 | 9/2002 |
| WO | 2009128752 | A1 | 10/2009 |
| WO | 2010130293 | A1 | 11/2010 |

* cited by examiner

*Primary Examiner* — Benny Lee
(74) *Attorney, Agent, or Firm* — Coats & Bennett, PLLC

(57) ABSTRACT

A transition (100, 300) from microstrip to waveguide, the waveguide comprising first (120) and second (105, 105', 105") interior surfaces connected by side walls (115, 116) whose height ($h_1$, $h_2$, $h_3$) is the shortest distance between said interior surfaces, and a microstrip structure (130, 135, 110) extending into the closed waveguide (105). The microstrip structure comprises a microstrip conductor (130, 135) on a dielectric layer arranged on said first interior surface. The microstrip conductor (130, 135) comprises and is terminated inside the closed waveguide by a patch (135). The height ($h_1$) of the side walls (115, 116) along the distance that the microstrip conductor (130, 135) extends into the closed waveguide (105) being less than half of the greatest height (h3) beyond the microstrip structure's protrusion into the closed waveguide (105).

8 Claims, 8 Drawing Sheets

TRANSITION BETWEEN A MICROSTRIP PROTRUDING INTO AN END OF A CLOSED WAVEGUIDE HAVING STEPPED SIDEWALLS

TECHNICAL FIELD

The present invention discloses an improved microstrip to closed waveguide transition.

BACKGROUND

A transition from a microstrip to a closed waveguide is a key component in microwave technology.

The current high volume trend in electronics and microwave designs is to use traditional circuit board techniques for the integration of packaged microwave circuits, and it is thus desirable to make transitions from microstrip to closed waveguide with a design that allows for the use of so called surface mount technology, usually abbreviated as SMT.

One popular design for such transitions is the so called E-probe, which comprises a closed waveguide with a pin probe which protrudes from one of the closed waveguide's walls into the closed waveguide roughly a quarter of a wave length from the closed waveguide's end. Although such a transition is not based on SMT-components, it allows the use of traditional SMT-boards.

Another alternative is to let a microstrip to closed waveguide transition be based on a so called ridge waveguide. In this case, there is first a transition from microstrip to ridge wave guide, and then a transition from ridge waveguide to closed waveguide. Electromagnetic propagation takes place along the circuit board and along the microstrip. Such a solution provides SMT compatibility.

Some drawbacks with these known technologies are as follows: An E-probe transition gives high loss since the electromagnetic field has to travel through a dielectric material on the circuit board. Due to band width limitations in combination with variations in etching, inner-layer registration, positions of vias, etc, it becomes increasingly difficult to use this technology with increasing frequencies and/or bandwidth. Another drawback with an E-probe transition is that it requires two waveguide pieces, one on each side of the board.

A transition based on a ridge waveguide will have electromagnetic leaks around the ridge waveguide's end. In most cases, the transition is arranged inside a metallic enclosure, which will create electromagnetic resonances unless the enclosure is filled with absorbing material. Another drawback of a transition based on a ridge waveguide is that reliable galvanic contact must be made where the microstrip meets the ridge. A certain size of such a joint is also required in order to enable reliable contact, which leads to limited design freedom in the microwave optimization, which in turn limits the bandwidth of the transition.

SUMMARY OF THE INVENTION

It is an object of the invention to obviate at least some of the drawbacks of known transitions from microstrip to closed waveguide.

This object is attained by the invention by means of a transition from microstrip to closed waveguide. The transition comprises a closed waveguide with opposing first and second interior surfaces which are connected by opposing side walls.

The height of the side walls is here defined as the shortest distance between the interior surfaces, and the transition also comprises a microstrip structure which protrudes into an opening at one end of the closed waveguide. The microstrip structure comprises a microstrip conductor which is arranged on a dielectric layer which in turn is arranged on the first interior surface of the waveguide. The microstrip conductor comprises and is terminated inside the closed waveguide by means of a patch which is at least twice the width of the rest of the microstrip conductor and which has a length which is smaller than the shortest distance between the side walls and greater than ⅛ of the shortest distance between the side walls.

The height of the side walls along the distance that the microstrip conductor extends into the closed waveguide is less than half of the greatest height of the side walls beyond the microstrip structure's protrusion into the closed waveguide.

This can also be expressed as saying that the microstrip conductor comprises and terminates in a patch, and that the "ceiling" of the waveguide exhibits a step-wise structure, with a lowest step being positioned above the patch, and that the next step, beyond the patch, has a height which is at least twice that of the height above the patch. An example of a suitable range for the height of "the lowest step" is from ½ the thickness of the dielectric layer to 4 times the thickness of the dielectric layer.

This design leads to an SMT compatible transition between microstrip and closed waveguide, and the termination of the microstrip conductor by means of a patch designed as described above in combination with the design of the side walls' height will, in combination, result in a strong coupling between the electromagnetic field around the microstrip structure and the field in the closed waveguide. The design of the side walls' height will focus the closed waveguide's electromagnetic field to the region where the patch field is strong, thereby increasing the field coupling between the two fields. The patch will act as a resonator which will tend to build up the field strength, which in turn will increase coupling. It is possible, to further increase the coupling between the two fields if a resonator is also created for the waveguide field, through the introduction of an "iris", which can improve the bandwidth of the transition.

In embodiments of the transition, the height of the side walls along the distance that the microstrip conductor extends into the closed waveguide is $\lambda/8$ or less, where $\lambda$ is the free space wavelength which corresponds to the operational frequency of the transition.

In embodiments of the transition, the microstrip conductor is galvanically connected to the first interior surface by means of at least one via connection.

In embodiments of the transition, the height of the side walls has at least one intermediate value before reaching said greatest height.

In embodiments of the transition, the dielectric layer protrudes into the closed waveguide beyond the patch.

In embodiments of the transition, the dielectric layer protrudes into the closed waveguide beyond the patch and is covered by a layer of a conducting material which is galvanically separated from the patch.

In embodiments of the transition, the shortest distance between the side walls of the closed waveguide varies along the extension of the closed waveguide, so that one or more "irises" are formed along the extension of the closed waveguide.

In embodiments of the transition, the microstrip conductor comprises a matching network which connects it to the patch. In some such embodiments of the transition, the matching network comprises a widening or narrowing of the microstrip conductor before the patch.

In embodiments, the transition comprises a wall of a conducting material where the microstrip conductor enters the closed waveguide, and the opening is an opening in this wall. The wall is galvanically connected to the first major surface of the closed waveguide.

BRIEF DESCRIPTION OF THE DRAWINGS

The invention will be described in more detail in the following, with reference to the appended drawings, in which.

DETAILED DESCRIPTION OF THE INVENTION

Figure 1:
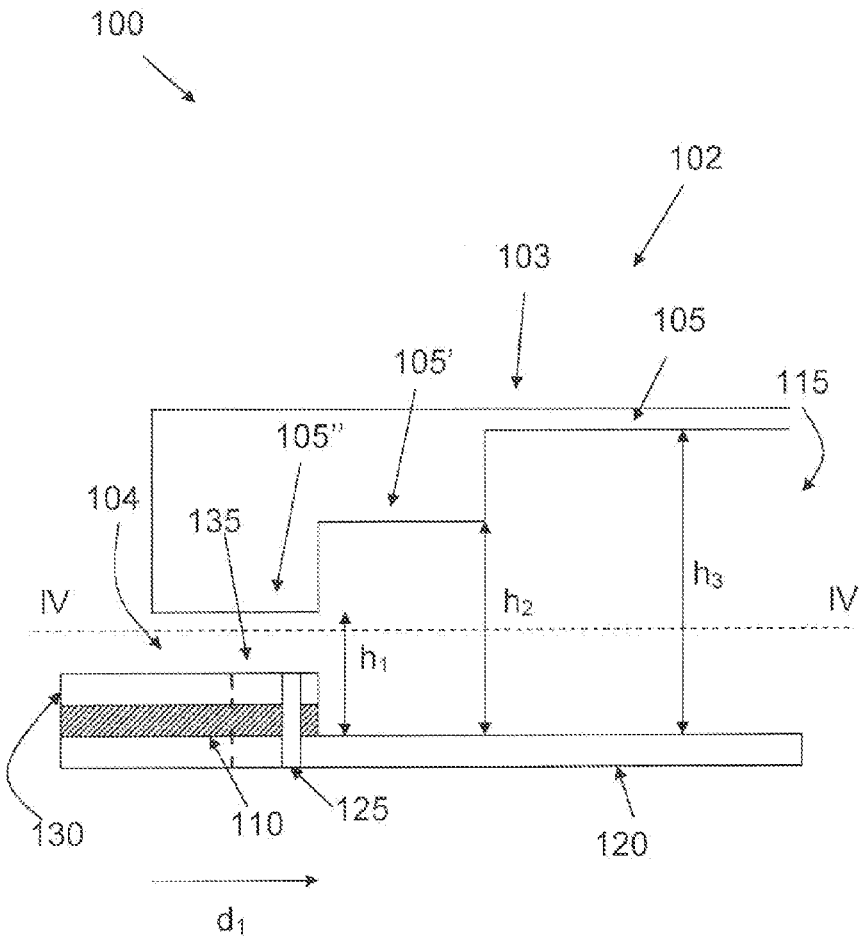
FIG. 1 shows a cross sectional view of a first embodiment.

Embodiments of the present invention will be described more fully hereinafter with reference to the accompanying drawings, in which embodiments of the invention are shown. The invention may, however, be embodied in many different forms and should not be construed as being limited to the embodiments set forth herein. Like numbers in the drawings refer to like elements throughout, and may not be described in detail in every drawing in which they may appear.

The terminology used herein is for the purpose of describing particular embodiments only, and is not intended to limit the invention.

FIG. 1 shows a cross-sectional view of a first embodiment 100 of a microstrip to waveguide transition of the invention. The transition 100 comprises a closed waveguide 102, which is an elongated rectangular closed structure which comprises a "floor" 120 and a "ceiling" opposite to the floor 120. The floor 120 and the ceiling 105 can also be seen as first and second interior surfaces of the closed waveguide 102. As shown in FIG. 1, the ceiling is arranged at stepwise varying heights h1, h2, h3, from the floor 120. The reason for this will be explained in more detail later in this text. The "outside" of the ceiling 103, i.e. the "top side" of the closed waveguide 102, is shown in FIG. 1 as being plane, which is one embodiment of the ceiling.

The floor 120 and the ceiling 105 of the closed waveguide 102 are connected by opposing side walls, one of which is indicated in FIG. 1 as 115, and the height of which is here defined as the shortest distance between the floor 120 and the ceiling 105, i.e. the side walls 115, 116 (e.g., See FIG. 4) extend in a direction perpendicular to the floor and the ceiling. Naturally, the floor 120, the ceiling 105 and the opposing side walls 115, 116, are made of an electrically conducting material.

In addition to the closed waveguide 102, the transition 100 also comprises a microstrip structure which protrudes into an opening 104 at one end of the closed waveguide 102.

The microstrip structure comprises a microstrip conductor 130 with a certain width (here defined as its extension in the perpendicular, or shortest, direction between the side walls), which is arranged on a dielectric layer 110 which in turn is arranged on the floor 120 of the closed waveguide 102. In some embodiments, the entire transition 100 is arranged on the surface of a circuit board, which has a dielectric top layer on at least a part of its surface, and a conducting (metal) ground layer beneath the dielectric top layer beneath at least part of the dielectric layer. In such embodiments, the transition 100 can utilize the conducting (metal) ground layer of the circuit board as the floor 120 of the closed waveguide 102, and the dielectric top layer of the circuit board can be utilized as the dielectric layer 110.

Figure 4:
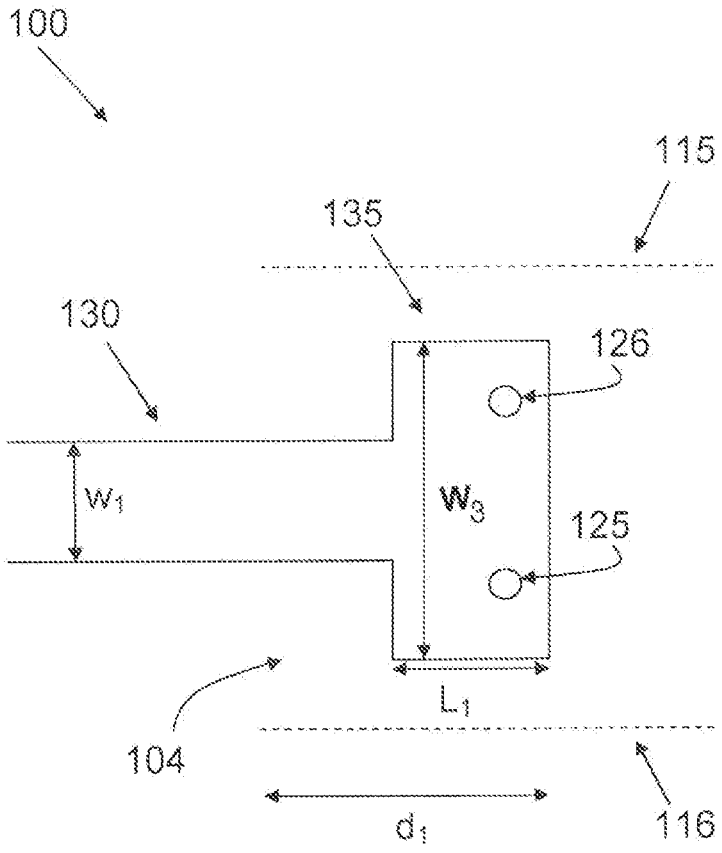
FIG. 4 shows the embodiment of FIG. 1 along the line IV-IV in FIG. 1.

The microstrip structure also comprises a conducting patch 135 which is also arranged on the dielectric layer 110 and to which the microstrip conductor 130 connects. Reference can here also be made to FIG. 4, since the patch 135 cannot be seen in a cross sectional view such as FIG. 1. The conducting patch 135 has a width, defined in the same manner as the width of the microstrip conductor 130 which is at least twice the width of the rest of the microstrip conductor 130 and has a length (i.e. an extension in a direction perpendicular to that of the width of the microstrip conductor 130, i.e. an extension straight into the closed waveguide) which is smaller than the shortest distance between the side walls and greater than ⅛ of the shortest distance between the side walls.

As is also shown in FIG. 1, the microstrip structure with the conductor 130 and the patch 135 protrudes a distance $d_1$ into the closed waveguide 102 as seen from the opening 104. The height $h_1$ of the side walls 115, 116 of the closed waveguide 102 along the distance $d_1$ is less than half of the greatest height $h_3$ beyond the distance $d_1$ that the microstrip conductor 130 including the patch 135 protrudes into the closed waveguide 102.

Thus, the side walls 115, 116 have a common height which varies along the lengthwise extension of the closed waveguide 102. Suitably, as shown in the embodiment in FIG. 1, the height of the side walls has at least three different values $h_1$, $h_2$, $h_3$, so that there is an intermediate height $h_2$ between the lowest height $h_1$ and the maximum height $h_3$, although it is also possible to have only two different values of the height of the walls. In addition, at the positions where the height of the side walls changes, i.e. at the transition between the different heights $h_1$, $h_2$ and $h_3$, the transition is made in as short a distance as possible, i.e. in a direction perpendicular to the floor 120 and ceiling 105 of the closed waveguide 102, which gives the closed waveguide 102 a "stair-like" shape, as shown in FIG. 1. However, regarding the design of the transitions between the different heights $h_1$, $h_2$ and $h_3$, i.e. the "steps" of the stair-like shape, the following can be said: It is advantageous to create a resonance in the closed waveguide around the patch. This requires the first step, i.e the transition between $h_1$ and $h_2$, to be fairly distinct or perpendicular. Beyond (into the closed waveguide) that step, it is possible to have either step-like transitions or gradual increases in height, i.e. "sloping" steps (not shown).

A suitable value for the height $h_1$ is $\lambda/8$ or less, where $\lambda$ is the free space wave-length which corresponds to the operational frequency of the transition. Since, as stated above, $h_1$ should be less than half of $h_3$, this gives us a suitable value of $\lambda/4$ for $h_3$. In addition, a suitable value of $h_2$ would be a value in between $\lambda/4$ and $\lambda/8$, for example $\lambda/6$.

The different heights, and the distances between steps should be designed such that a desired filter function is obtained, for example a Chebyshev or a Butterworth filter. Each section of the transition 100 which has constant height from the floor 120 to the ceiling 105, 105', 105", forms a resonator whose resonance frequency is set mainly by the distance between steps in height; the coupling between adjacent such resonators is set by the "step" size, i.e. the difference in height between adjacent sections. For each added step, return loss and bandwidth of the transition 100 is improved, at the expense of added losses.

As shown in FIG. 1, in embodiments the microstrip conductor 130 is galvanically connected to the first interior surface 120 ("the floor" of the closed waveguide) by means of at least one via connection 125 from the patch 135, where the via conductor 125 thus extends through the dielectric layer 110.

The vias 125 and the patch 135 together form a quarter wave resonator, which helps to improve the bandwidth of the transition 100 since the patch 135 will act as a so called 8-probe ("current loop") at low frequencies and as an E-probe (dipole) near the resonance frequency of the quarter wave resonator.

Figure 2:
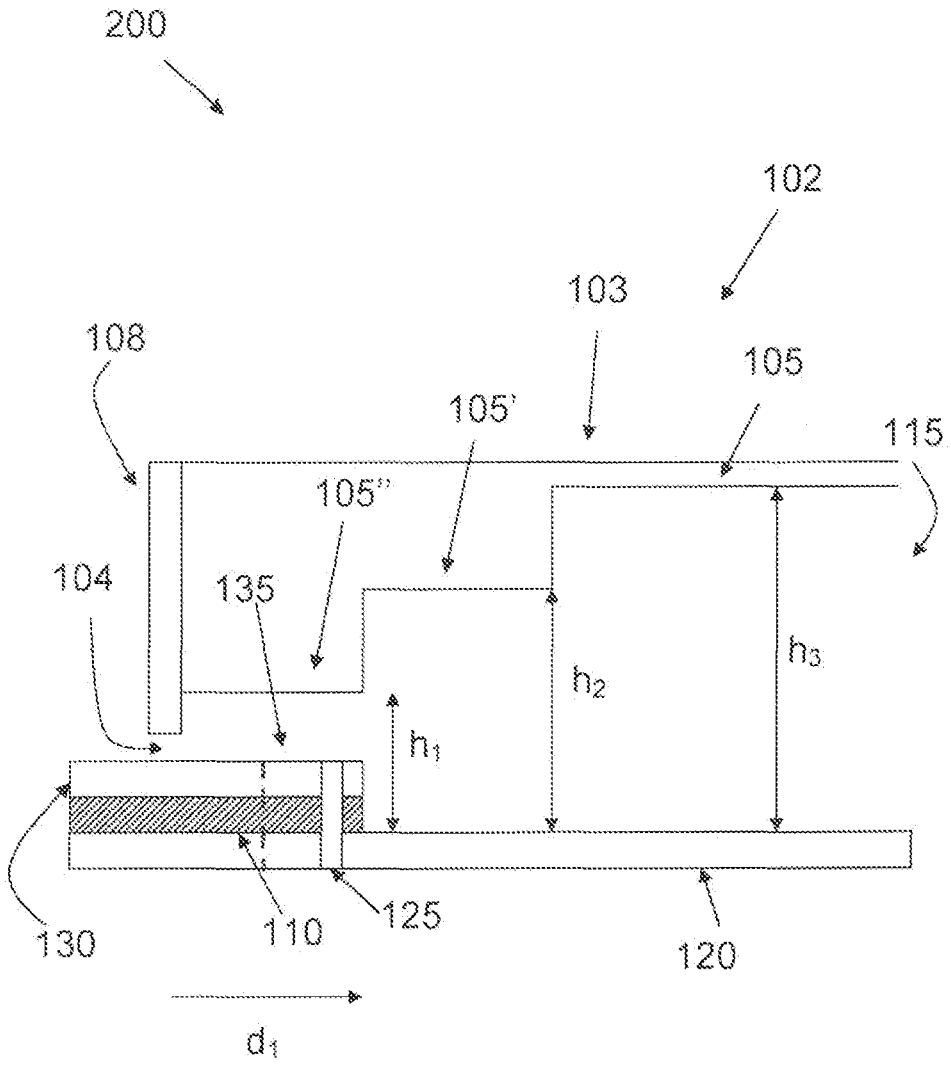
FIG. 2 shows a cross sectional view of a second embodiment.

FIG. 2 shows a second embodiment 200, which is similar to the first embodiment 100 shown in FIG. 1, but which includes a cover or wall 108 of a conducting material where the microstrip structure enters the closed waveguide, so that the opening 104 is an opening in the wall 108. In this embodiment, the opening 104 is just large enough to admit the microstrip structure. A suitable range of values for the dimension of the opening 104 in this embodiment is that its width should be 2-6 times that of the microstrip structure, and its height should be 0.5-2 times that of the microstrip structure.

The wall 108 is arranged to be in galvanic contact with the "floor" i.e. the first major surface 120 of the closed waveguide 102, as well as suitably also with the opposing sidewalls 115, 116 and with the second major surface 103 of the closed waveguide 102.

Figure 3:
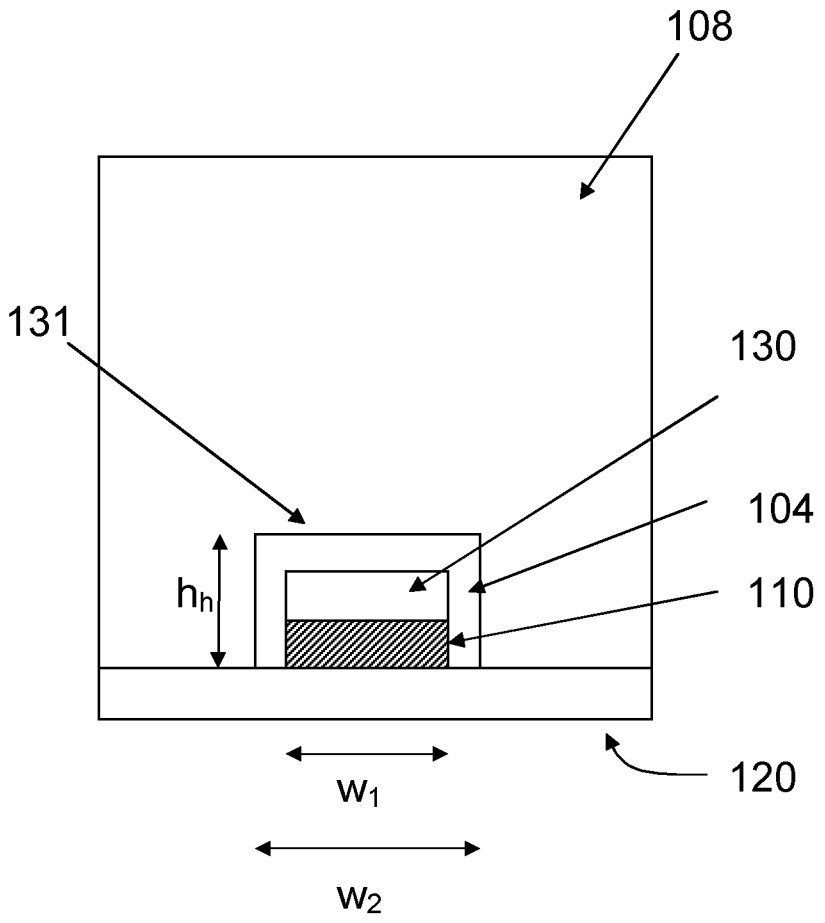
FIG. 3 shows a "front view" of parts of the embodiment of FIG. 2.

FIG. 3 shows a front view of the embodiment of FIG. 2, i.e. a view seen along the extension of the microstrip structure, at a point where the microstrip structure enters the closed waveguide 102. The front wall 108 is shown, as are the dielectric layer 110, the microstrip conductor 130, the opening 104 and the first interior surface 120 of the closed waveguide 102. The front wall 108 is arranged to have galvanic contact with the first interior surface 120 of the closed waveguide 102, and also with the (not shown) second interior surface 105 as well as the side walls 115, 116 (not shown) of the closed waveguide 102.

In FIG. 3, the dimensions of the opening 104 in the embodiment with a front wall 108 are shown: suitably, the opening 104 is rectangular, with a height $h_h$ and a width $w_2$, with the following dimensions: the height $h_h$ is suitably in the range of 0.3 to 3 times larger than the perpendicular or shortest distance from the top of the microstrip conductor 130 to the top 131 of the opening 104, and the width $w_2$ of the opening is suitably in the range of 2 to 6 times the width $w_1$ of the microstrip conductor 130. The width $w_1$ is defined in more detail below in connection with FIG. 4. In FIG. 3, the microstrip conductor 130 and the dielectric layer 110 are shown to be of equal width. In embodiments where the dielectric layer 110 is wider than the microstrip conductor 130, a "slit" may be made in the dielectric layer 110 in order to accommodate the front wall 108.

FIG. 4 shows the embodiment 100 of FIG. 1 in an open view along the line IV-IV of FIG. 1, i.e. in a "top view" with the ceiling 105 of the closed waveguide 102 removed. In this view, the patch 135, and the other part of the microstrip conductor 130, which connects to the patch 135 can be seen more clearly. Here, it can be see more clearly how the microstrip conductor 130 connects to the conducting patch 135. Another way of looking at this is to say that the microstrip conductor 130 and the conducting patch 135 are part of one and the same conducting (metal) layer or "body", and that there is a seamless transition in this body from microstrip conductor 130 to the conducting patch 135. In addition, the different widths $w_1$ of the microstrip conductor 130 and $w_3$ of the conducting patch 135 can also be seen here, as well as the length $L_1$ of the conducting patch 135. It should be pointed out that although the conducting patch 135 is shown and described here as being rectangular, the conducting patch can be given a number of varying shapes, such as circular or semi-circular. In addition, it should be pointed out that the dimensions in FIG. 4 as well as in the other figures are not to scale.

Figure 5:
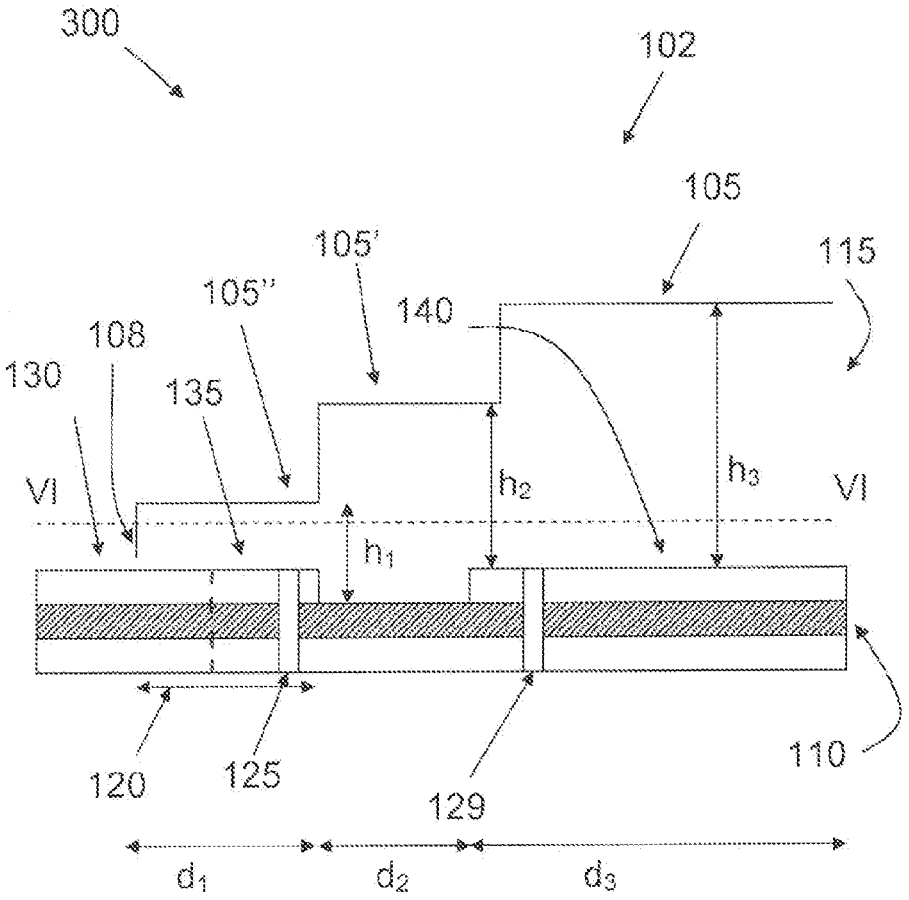
FIG. 5 shows a cross-sectional view of a third embodiment.

As is also shown in FIG. 4, there can be more than one via which connects the conducting patch to the first main surface 120. In FIG. 4, the via 125 from FIG. 1 is shown, as well as one additional such via 126. In addition, in FIG. 4, it can also be clearly seen how the microstrip structure protrudes a certain distance $d_1$ into the closed waveguide 102. In the embodiments shown and described so far, the dielectric layer 120 extended the same distance $d_1$ into the closed waveguide 102 from the opening 104. However, as mentioned previously, in some embodiments, the first main surface 120 and/or the dielectric layer 110 are part of a main surface of a circuit board. In such embodiments, the dielectric layer will extend or protrude into the closed waveguide beyond the patch 135, i.e. beyond the distance $d_1$ from the opening 104 in the closed waveguide 102. Such an embodiment 300 is shown in FIG. 5, in the same view as the embodiment 100 was shown in FIG. 1. Components or details which the embodiment 300 has in common with the embodiment 100 have retained their reference numbers in FIG. 3.

Thus, as shown in FIG. 5, in the embodiment 300, the dielectric layer 110 extends beyond the distance $d_1$, into the closed waveguide 102 on the first main surface 120. In one embodiment, which is shown in FIG. 5, the dielectric layer 110 protrudes into the closed waveguide 102 beyond the conducting patch 135, and is covered by an upper layer 140 of a conducting material which can be separated from the conducting patch 135 by a distance $d_2$. A distance $d_3$ is also show in FIG. 5, which is an example of how far the upper layer 140 of a conducting material extends into the closed waveguide 102. FIG. 5 also shows a second via connection 129.

The different heights $h_1$, $h_2$ and $h_3$ of the side walls 115, 116 (not shown), are in FIG. 5 shown as extending only from the upper layer 140 of a conducting material. Although this is correct, it should however be pointed out that the proportions in the drawings are not to scale, but are greatly magnified in some cases: for example, the thickness of the dielectric layer 110 and the upper layer 140 of a conducting material are in reality very small as compared to the heights $h_1$, $h_2$ and $h_3$.

Figure 6:
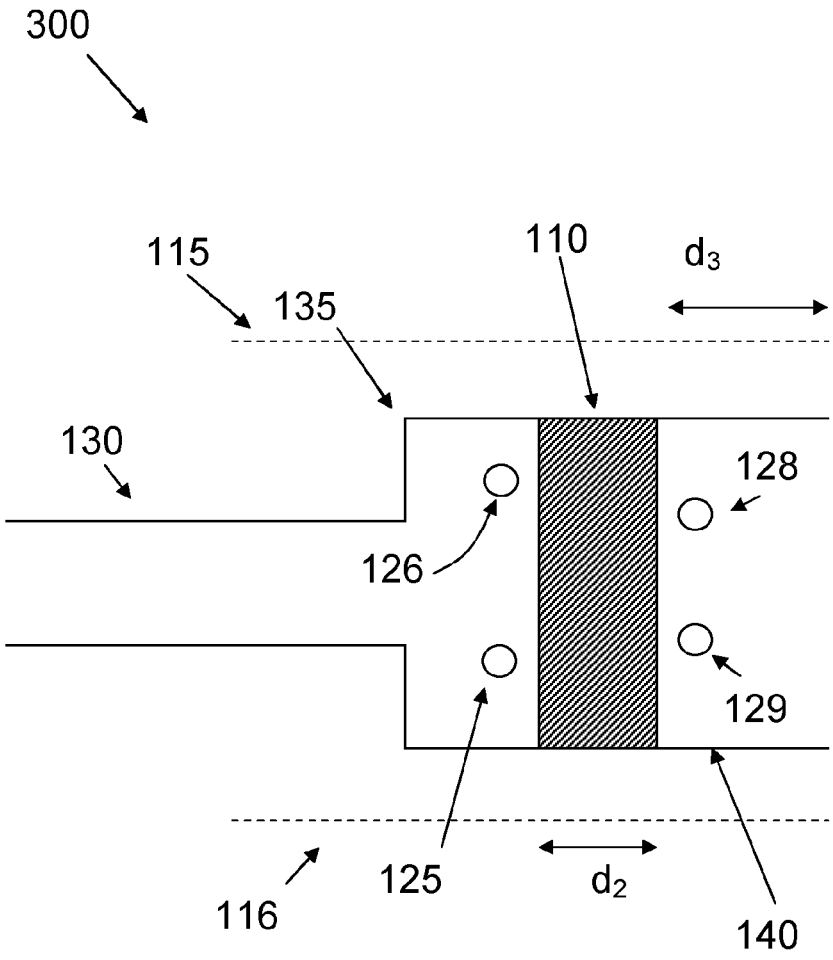
FIG. 6 shows the embodiment of FIG. 5 along the line VI-VI in FIG. 5.

FIG. 6 shows the embodiment 300 of FIG. 5 opened along the line VI-VI of FIG. 5, i.e. an open top view with the "ceiling" of the closed wave guide 102 removed. The upper layer 140 of a conducting material is clearly seen here, as is the "gap" d2 between the upper layer 140 of a conducting material and the conducting patch 135. Through the gap d2, the dielectric layer 110 can be seen. Also, the via connection 128 and one more via connection 129 are shown, and extend from the upper layer 140 of a conducting material through the dielectric layer 110 to the first main surface 120 of the closed waveguide 102 are shown.

Figure 7A:
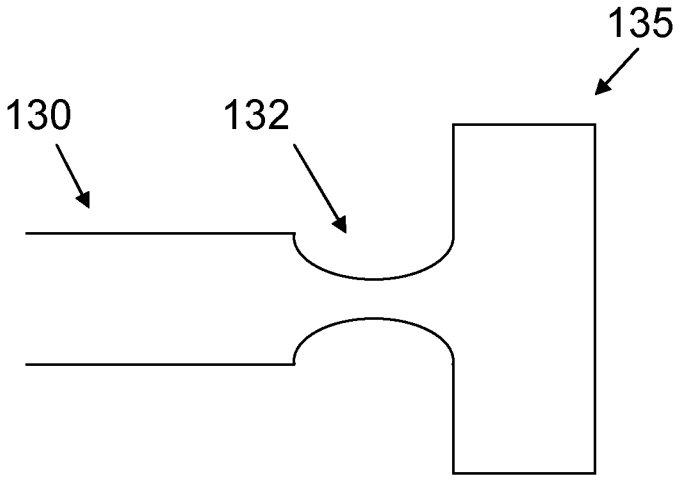
FIG. 7 shows top views of alternative embodiments of the microstrip conductor.
Figure 7B:
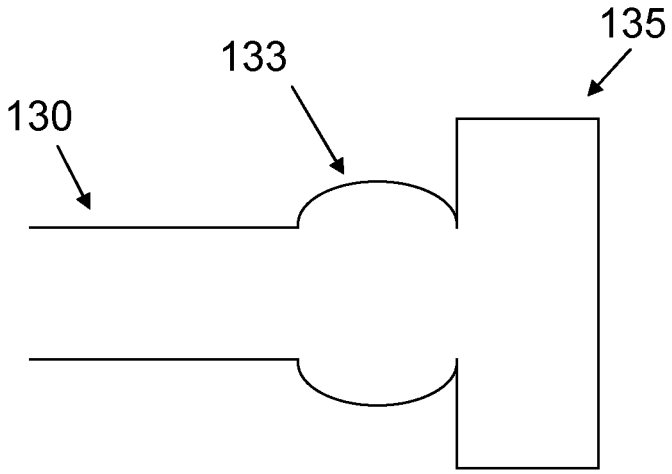

In both the embodiments 100 and 300, it can be advantageous to include a matching network between the microstrip conductor 130 and the conducting patch 135. In some embodiments, such a matching network is formed by means of a widening or a slimming of the microstrip conductor 130 before it meets or connects to the conducting patch 135. Examples of such embodiments are shown in FIGS. 7*a* and 7*b*, which show a slimming 132 (FIG. 7*a*) of the microstrip conductor 130 before it meets the conducting patch 135, and a widening 133 (FIG. 7*b*) of the microstrip conductor 130 before it meets the conducting patch 135, respectively.

Figure 8:
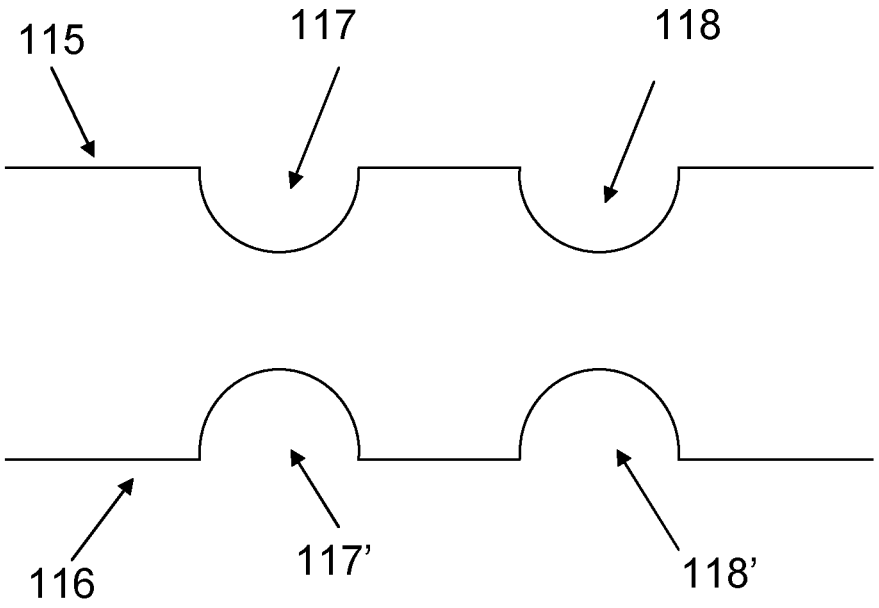
FIG. 8 shows an open top view of an embodiment of the side walls of the closed waveguide.

In some embodiments, the opposing side walls 115, 116, exhibit one or more "irises", which are opposing inwardly narrowing sections, i.e. opposing concave sections in the side walls 115, 116, along the extension of the closed waveguide. This is shown in FIG. 8, which shows an opened schematic top view of either embodiment 100, 300. As shown, the opposing side walls 115, 116, in two places exhibit opposing inwards bends 117-117' and 118-118'. Such irises can be used as a complement to the steps described previously, in order to create reflections in the closed waveguide, which in turn will create resonances in the wave propagation. Frequencies and couplings can be tuned so that such a desired filter function is achieved. Tuning is made by adjusting the curvature and magnitude (their extension inwards into the closed waveguide) of the irises and the distance between the irises Throughout this description, the expression "closed waveguide" has been used. This is in order to distinguish the closed waveguide from such waveguide types as microstrip or strip line waveguides, and, as emerged from the description, is used in order to refer to a waveguide which has the shape of a "tunnel" that is open at two distal ends. The "tunnel" which has been described above and in the drawings has a rectangular cross-section.

In the drawings and specification, there have been disclosed exemplary embodiments of the invention. However, many variations and modifications can be made to these embodiments without substantially departing from the principles of the present invention. Accordingly, although specific terms are employed, they are used in a generic and descriptive sense only and not for purposes of limitation.

The invention is not limited to the examples of embodiments described above and shown in the drawings, but may be freely varied within the scope of the appended claims.

The invention claimed is:

1. An arrangement structure for a transition from microstrip to closed waveguide, comprising:

a closed waveguide with opposing first and second interior surfaces connected by opposing side walls having a height thereof that is a shortest distance between the interior surfaces;

a microstrip structure which protrudes into an opening at one end of the closed waveguide, the microstrip structure comprising a microstrip conductor disposed on a dielectric layer which in turn is parallel to and disposed partially overlying the first interior surface of the waveguide;

the microstrip conductor including a conducting patch that terminates the microstrip conductor inside the closed waveguide, the conducting patch being at least twice a width of the rest of the microstrip conductor and having a length smaller than a shortest distance between the opposing side walls and greater than ⅛ of the shortest distance between the opposing side walls;

the height of the opposing side walls respectively varies stepwise from a lowest height, along a length of the closed waveguide, to at least one greater height, wherein at any given point along the length of the closed waveguide, the stepwise varying opposing side walls have a common height;

wherein a first transition from the lowest height to the at least one greater height is perpendicular to the first and second interior surfaces;

wherein the lowest height is less than half a greatest height of the opposing side walls beyond a distance that the microstrip conductor protrudes into the closed waveguide;

wherein the height of the opposing side walls, along the distance that the microstrip conductor protrudes into an closed waveguide, is $\lambda/8$ or less, where $\lambda$ is a free-space wave length corresponding to the operational frequency of the transition;

wherein the conducting patch is galvanically connected to the first interior surface by at least one via connection between the conducting patch and the first interior surface, which forms a quarter wave resonator together with the conductor patch.

2. The arrangement of claim 1, where the shortest distance between the opposing side walls of the closed waveguide varies due to at least one pair of opposing concave portions along an extension of the closed waveguide.

3. The arrangement of claim 1, wherein the microstrip conductor comprises a matching network which connects the microstrip conductor to the conductor patch.

4. The arrangement of claim 3, wherein the matching network comprises one or more pairs of opposing concave sections of the microstrip conductor located before the conductor patch.

5. The arrangement of claim 1, wherein the first interior surface of the waveguide comprises a ground plane of a circuit board, and wherein the dielectric layer parallel to and disposed partially overlying the first interior surface comprises a dielectric top layer of the circuit board partially overlying the ground plane.

6. The arrangement of claim 1, wherein the height of the opposing side walls has at least one intermediate value beyond the distance that the microstrip conductor protruding into the closed waveguide before reaching a greatest height.

7. The arrangement of claim 1, in which the dielectric layer protrudes into the closed waveguide beyond the conductor patch.

8. The arrangement of claim 7, wherein the dielectric layer is covered by another layer of a conducting material that is spaced from and galvanically separated from the conductor patch.

* * * * *